US009060656B2

(12) United States Patent
Tong

(10) Patent No.: US 9,060,656 B2
(45) Date of Patent: Jun. 23, 2015

(54) DRAIN STOPPER ASSEMBLY

(76) Inventor: Henry Tong, Northville, MI (US)

( * ) Notice: Subject to any disclaimer, the term of this patent is extended or adjusted under 35 U.S.C. 154(b) by 260 days.

(21) Appl. No.: 13/701,697

(22) PCT Filed: Jun. 17, 2011

(86) PCT No.: PCT/US2011/040858
§ 371 (c)(1),
(2), (4) Date: Feb. 5, 2013

(87) PCT Pub. No.: WO2011/160000
PCT Pub. Date: Dec. 22, 2011

(65) Prior Publication Data
US 2013/0125299 A1 May 23, 2013

Related U.S. Application Data

(60) Provisional application No. 61/356,311, filed on Jun. 18, 2010.

(51) Int. Cl.
*A47K 1/14* (2006.01)
*E03C 1/23* (2006.01)

(52) U.S. Cl.
CPC ... *A47K 1/14* (2013.01); *E03C 1/23* (2013.01); *E03C 1/2306* (2013.01)

(58) Field of Classification Search
CPC ..... A47K 1/14; E03C 1/23; E03C 1/2302
USPC ..... 4/295, 286–294
See application file for complete search history.

(56) References Cited

U.S. PATENT DOCUMENTS

| | | | | |
|---|---|---|---|---|
| 577,813 | A * | 2/1897 | Upson | 220/811 |
| 1,760,659 | A | 5/1930 | Pasman | |
| 2,077,516 | A | 4/1937 | Dart | |
| 2,348,093 | A * | 5/1944 | Pasman | 4/287 |
| 3,010,118 | A | 11/1961 | Isherwood | |
| 3,071,781 | A | 1/1963 | Seewack | |
| 3,366,980 | A | 2/1968 | Petursson et al. | |
| 3,368,788 | A | 2/1968 | Padula | |
| 3,428,295 | A | 2/1969 | Downey et al. | |
| 3,652,054 | A | 3/1972 | Layton | |
| 3,849,809 | A | 11/1974 | Morris et al. | |
| 3,995,333 | A | 12/1976 | Stephens | |
| 4,045,351 | A | 8/1977 | Peterson | |
| 4,207,631 | A | 6/1980 | Baggey | |
| 4,369,531 | A | 1/1983 | Swanson | |
| 4,420,844 | A | 12/1983 | Puckett et al. | |

(Continued)

FOREIGN PATENT DOCUMENTS

| | | | |
|---|---|---|---|
| JP | 8277559 | A | 10/1996 |
| JP | 2002054206 | A | 2/2002 |
| JP | 2010216210 | A | 9/2010 |

*Primary Examiner* — Huyen Le
*Assistant Examiner* — Christine Skubinna
(74) *Attorney, Agent, or Firm* — Endurance Law Group, PLC

(57) ABSTRACT

A drain stopper assembly for selectively closing an outlet from a water basin includes a stopper that axially slidably interacts with a support post to move between raised and lowered positions. In a raised position, the stopper can be laterally displaced to facilitate periodic cleaning of debris trapped in the drain passage. Lateral displacement can be accomplished in a variety of ways including by way of groove and follower pin relationships, pivoting sections of the support post and/or post interface of the stopper, and by a flexible support post.

16 Claims, 8 Drawing Sheets

(56) References Cited

U.S. PATENT DOCUMENTS

| | | | | |
|---|---|---|---|---|
| 4,457,030 | A | | 7/1984 | Burry |
| 4,720,877 | A | | 1/1988 | Watts |
| 4,908,883 | A | | 3/1990 | Rivera |
| 4,926,507 | A | | 5/1990 | Craig et al. |
| 4,932,082 | A | | 6/1990 | Ridgeway |
| 4,945,579 | A | | 8/1990 | Husting |
| 5,072,461 | A | | 12/1991 | Logsdon |
| 5,208,921 | A | | 5/1993 | Nicoll |
| 5,230,365 | A | | 7/1993 | Woltz et al. |
| 5,333,327 | A | | 8/1994 | Redding et al. |
| 5,363,519 | A | | 11/1994 | Husting |
| 5,428,847 | A | | 7/1995 | Atkins et al. |
| 5,615,447 | A | | 4/1997 | Hardesty et al. |
| 5,640,724 | A | | 6/1997 | Holmes |
| 5,744,048 | A | | 4/1998 | Stetler |
| 5,749,105 | A | | 5/1998 | Bruno et al. |
| 5,758,368 | A | | 6/1998 | Ball |
| 5,832,544 | A | * | 11/1998 | Pan ..... 4/293 |
| 5,881,397 | A | | 3/1999 | Hobbs |
| 6,108,828 | A | | 8/2000 | Cheng |
| 6,138,290 | A | | 10/2000 | Lin |
| 6,282,730 | B1 | | 9/2001 | Duncan |
| 6,341,391 | B1 | | 1/2002 | Cheng |
| 6,363,544 | B1 | | 4/2002 | Ryan |
| 6,418,570 | B1 | | 7/2002 | Ball |
| 6,484,330 | B2 | | 11/2002 | Gray et al. |
| 6,490,739 | B1 | | 12/2002 | Lee |
| 6,640,358 | B2 | | 11/2003 | Ball |
| 6,725,472 | B2 | | 4/2004 | Gray et al. |
| 6,802,962 | B1 | | 10/2004 | Browne, III et al. |
| 6,880,179 | B2 | | 4/2005 | Wang |
| 7,086,550 | B2 | | 8/2006 | Yang et al. |
| 7,150,576 | B1 | | 12/2006 | Kambeyanda |
| 7,290,295 | B2 | | 11/2007 | Pan |
| 7,530,123 | B2 | | 5/2009 | Cao et al. |
| 2004/0079720 | A1 | | 4/2004 | Croskrey |
| 2004/0089663 | A1 | | 5/2004 | Finkelstein |
| 2007/0241106 | A1 | | 10/2007 | Deg |
| 2009/0255041 | A1 | | 10/2009 | Duncan |
| 2009/0255054 | A1 | | 10/2009 | Duncan |

* cited by examiner

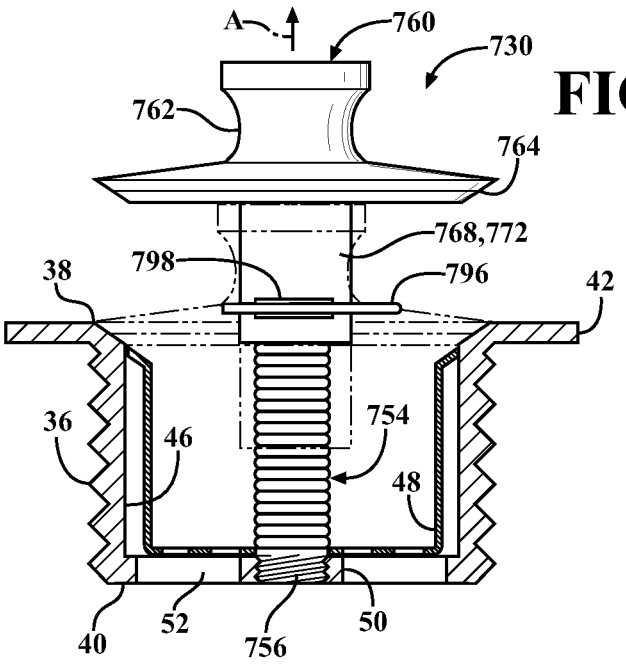
FIG. 22
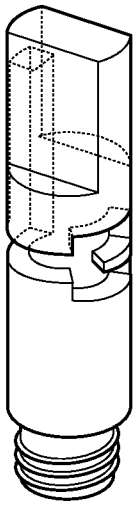
FIG. 24
FIG. 23
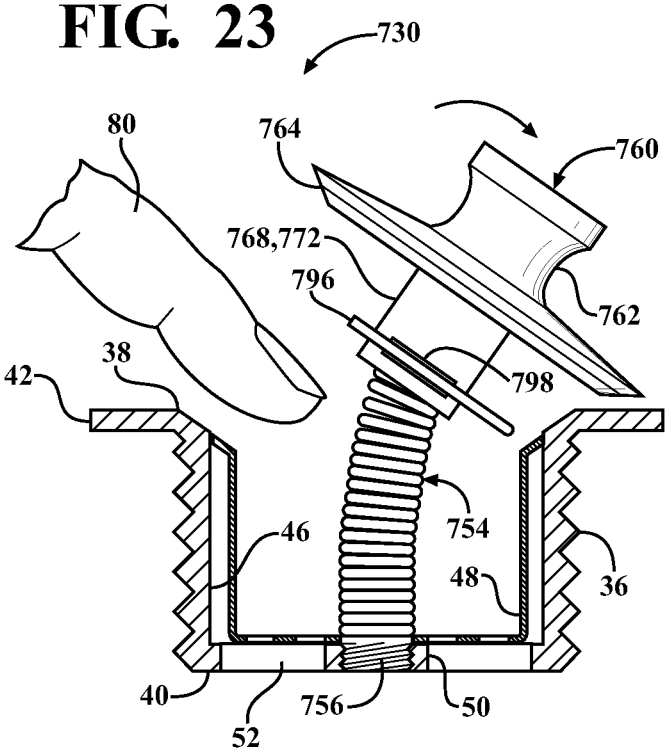
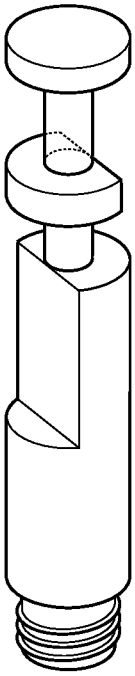
FIG. 25

DRAIN STOPPER ASSEMBLY

CROSS REFERENCE TO RELATED APPLICATIONS

This application claims priority to Provisional Patent Application No. 61/356,311 filed Jun. 18, 2010, the entire disclosure of which is hereby incorporated by reference and relied upon.

BACKGROUND OF THE INVENTION

1. Field of the Invention

The present invention relates generally to a drain plug or stopper disposed in an opening for a water basin such as a sink or bathtub, and more particularly toward a drain stopper assembly including a manually actuated reciprocating closure member for controlling the flow of water through the basin opening.

2. Related Art

Water basins are used in numerous applications for washing, storage, drinking and the like. Typically, such basins include an opening located at a lower extremity thereof so that water can drain under the influence of gravity. A stopper or closure device is placed in the opening to selectively prevent water from flowing through the opening. In many applications, water contained in the basin will contain debris in the form of hair, leaves, etc. which has the potential to clog the stopper device. When this occurs, it is typically necessary to remove completely the drain stopper and then reach one's finger or a cleaning tool into the drain passage to remove the clogged materials. Afterwards, the stopper device must be reinstalled. Many consider this removal and reinstallation process of the stopper to be unpleasant work.

FIG. 1 illustrates one exemplary water basin application in the form of a bathing tub. A drain assembly is disposed in the bottom of the tub for evacuating water through a drain pipe system. According to prior art traditions, the stopper assembly may be of the type shown in FIG. 2 wherein a closure member can be manually raised to let water flow out the drain and lowered to store water in the basin. In the lowered position, the closure member or stopper forms a seal with respect to the assembly housing so that water cannot pass through the central drain passage and into the piping system below. When debris caught in the stopper assembly builds to a sufficient degree, water flow is substantially diminished and/or arrested entirely even when the stopper is in the raised position. This is shown for example in FIG. 2 where a build-up of hair is trapped inside the drain passage. As stated previously, prior art drain stopper assemblies do not provide adequate clearance in the raised position for the average person's finger (80) or a suitable cleaning tool, thereby requiring complete removal of the stopper from the drain assembly.

This problem is inherent to all prior art drain stopper assemblies—namely such designs do not allow easy access to clean debris from within the drain passage. Examples of prior art drain stopper assemblies may be found in U.S. Pat. No. 3,071,781 to Seewack, granted Jan. 8, 1963; U.S. Pat. No. 4,926,507 to Craig et al., granted May 22, 1990; U.S. Pat. No. 5,072,461 to Logsdon, granted Dec. 17, 1991; U.S. Pat. No. 5,832,544 to Pan, granted Nov. 10, 1998; US 6,138,290 to Lin, granted Oct. 31, 2000; U.S. Pat. No. 6,418,570 to Ball, granted Jul. 16, 2002; and U.S. Pat. No. 6,363,544 to Ryan, granted Apr. 2, 2002.

There exists a need within the art of closures and stoppers for basins to provide greater and more convenient access when the drain passage becomes clogged with debris, without requiring disassembly of the stopper.

SUMMARY OF THE INVENTION

A drain stopper assembly is provided for selectively closing the outlet from a water basin such as a sink or a bathing tub. The stopper assembly comprises a housing adapted to insert into a drain hole opening in a basin for establishing a closeable drain passage through which water flows when draining from the basin. The housing defines a longitudinal axis. A support post is supported relative to the housing within the drain passage. A stopper is provided. The stopper includes a post interface axially slidably engaging the support post for allowing the stopper to move axially between raised and lowered positions. When the stopper is in the raised position, water is generally free to flow through the drain passage of the housing. In the lowered position, the stopper prevents water from flowing through the drain passage. A lateral displacement means is provided for allowing the stopper to move laterally relative to the longitudinal axis when it is in its raised position to facilitate periodic cleaning of debris trapped in the housing.

The invention is distinguished from prior art constructions and methods via its lateral displacement means which may be implemented or expressed in multiple different ways including but not limited to those illustrated and described. The lateral displacement means effectively allows the stopper to be moved in a direction which provides additional clearance space to the drain passage so that a person's finger or a suitable cleaning tool can be more easily placed into the drain passage for the purpose of clearing the obstruction without disassembling the stopper.

BRIEF DESCRIPTION OF THE DRAWINGS

These and other features and advantages of the present invention will become more readily appreciated when considered in connection with the following detailed description and appended drawings, wherein:

FIG. 22 is a side elevation of a seventh alternative embodiment of the subject invention showing the stopper in a raised position in solid lines and a lowered position in broken lines;

FIG. 23 is a view as in FIG. 22 of the seventh alternative embodiment showing the stopper laterally displaced to provide clearance for a human finger or other cleaning device to enter the drain passage;

FIG. 24 is a perspective view of a still further alternative embodiment of the support post; and FIG. 25 is a perspective view of yet another alternative embodiment of the support post.

DETAILED DESCRIPTION OF THE PREFERRED EMBODIMENT

Figure 1:
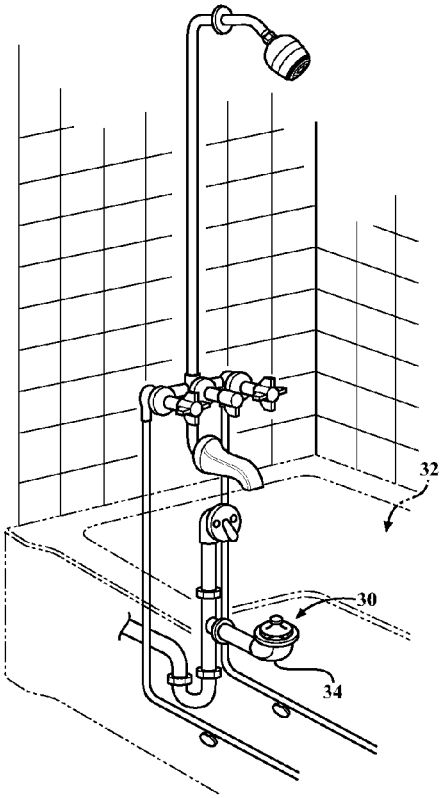
FIG. 1 is an environmental view showing one exemplary application of the subject invention disposed for use in a bathing tub.
Figure 2:
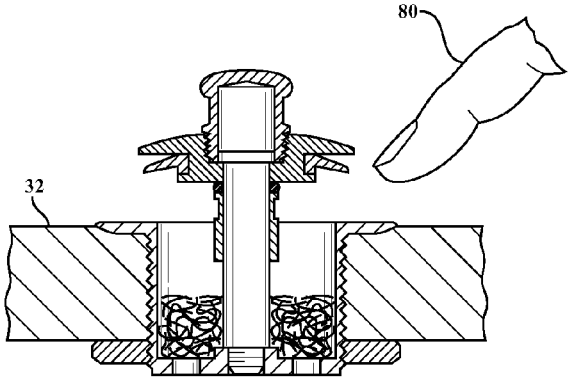
FIG. 2 PRIOR ART
FIG. 2 is a cross-sectional view of a prior art stopper construction in which insufficient clearance is provided for a person to reach obstructions trapped inside the drain passage of the stopper assembly.

Referring to the figures wherein like numerals indicate like or corresponding parts throughout the several views, a drain stopper assembly according to a preferred embodiment of this invention is generally shown at 30 in FIG. 1. The assembly 30 is shown disposed in a bathing tub 32 as an exemplary representation for any type of suitable water basin including but not limited to sinks, troughs, containers, vessels and the like. The basin 32 is provided with an outlet which communicates with an attached drain pipe 34. Water released from the basin 32 is directed to an appropriate sewer or drainage facility via the drain pipe 34. The drain stopper assembly 30 is effective to selectively close the basin outlet to control the discharge of water from the basin 32.

Figure 3:
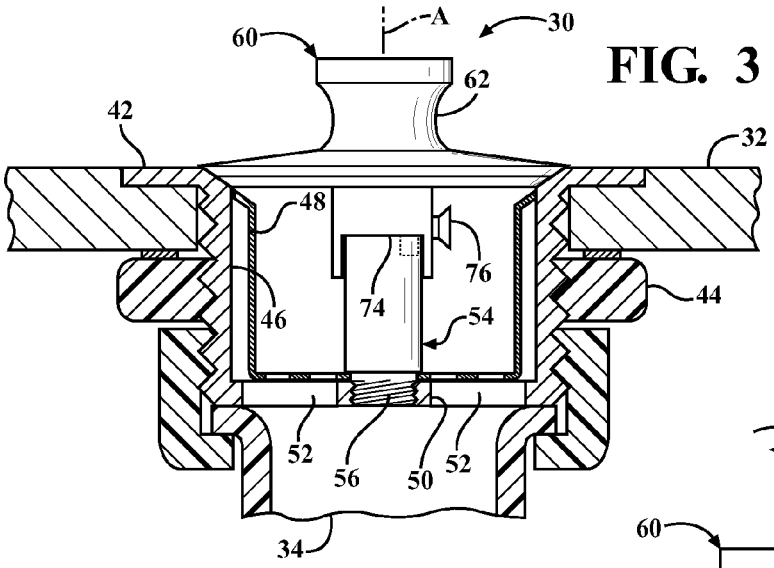
FIG. 3 is a side elevation view of a preferred embodiment of the subject invention showing the housing portion in cross-section and the stopper in a lower position so as to prevent water from flowing through the drain passage.

Turning now to FIGS. 3-7, the drain stopper assembly 30 is shown in greater detail. The stopper assembly 30 includes a housing 36 adapted to be inserted into the opening in the basin 32. The housing 36 may be generally cylindrical and centered about a central vertical or longitudinal axis A. It should be understood however that non-cylindrical variations of the housing 36 are certainly possible, and it is not essential that the longitudinal axis A be centered in the housing 36 nor even vertical in orientation. In this embodiment, the cylindrical housing 36 extends between top 38 and bottom 40 ends. The top end 38 may be generally planar with, or at least open upwardly into the basin 32. A mounting flange 42 may, in some applications, be provided extending radially outwardly from the top end 38 of the housing 36. The flange 42 seats in a recess or simply overlie the inner surface of the basin 32. An appropriate gasket or caulking material may be used to perfect a watertight seal between these members. A mounting nut 44 may be used to secure the housing 36 securely to the opening in the basin 32. The mounting nut 44 interacts with external threads formed about the cylindrical exterior of the housing 36. Of course, other mounting techniques may be used instead of, or in addition to, the mounting nut 44 arrangement shown in FIG. 3. The drain pipe 34 is also shown in FIG. 3 connecting to the bottom end 40 of the housing 36. Of course, many various techniques may be used to effect a suitable connection between the drain pipe 34 and the stopper assembly 30. The example shown in FIG. 3 is but one technique provided for illustrative purposes only.

The interior of the housing 36 establishes a drain passage 46 through which water flows when draining from the basin 32. Optionally, a removable or non-removable strainer 48 may be disposed within the drain passage 46 of the housing 36. The strainer 48 can be made from wire mesh, a slotted and/or perforated design, or according to any of the known techniques.

A hub 50 is disposed within the drain passage 46 adjacent the bottom end 40 of the housing 36. It should be noted that the specific location of the hub 50 relative to the bottom end 40 of the housing 36 is subject to design variation and can be adjusted to suit different applications. Furthermore, the preferred embodiment locates the hub 50 directly along the longitudinal axis A, and therefore centered within a generally cylindrical housing 36. Those of skill in this art will recognize that the placement of the hub 50 could, in alternative arrangements, be located off-center if desired. In the preferred embodiment illustrated in FIGS. 3-7, the hub 50 is supported by at least one, and preferably four spokes 52 which adjoin directly to the bottom end 40 of the housing 36. The spokes 52 are perhaps best shown in hidden lines in FIG. 6. Water exiting the basin 32 through the drain passage 46 freely flows around the spokes 52 and into the drain pipe 34.

The hub 50 includes a central aperture for receiving a support post, generally indicated at 54. The support post 54 includes a threaded tip 56 which engages complimentary threads in the hub 50 and causes the support post 54 to extend generally upwardly therefrom along the longitudinal axis A. Other fixation techniques can be used instead of interlocking threads between these parts. It will be understood that the support post 54, like the hub 50, can be located off-center and in fact does not necessarily need to be oriented parallel to the longitudinal axis A. However, in the preferred embodiment, the support post 54 does coincide with the longitudinal axis A and extends toward the top end 38 of the housing 36. Thus, the support post 54 is shown to be supported relative to the housing 36 within the drain passage 46 so that water exiting the basin 32 comes in direct contact with the support post 54. The strainer 48 includes a central hole 58 through which the threaded tip 56 of the support post 54 passes. The hole 58 can be large enough to allow the strainer 40 to be easily lifted out of the housing 36 while the support post 54 remains in place, or may be slightly smaller so that it becomes trapped between a shoulder of the support post 54 and the hub 50. In the latter case, the support post 54 must be unthreaded from the hub 50 in order to remove the strainer 48. Both applications have certain advantages and are within the contemplated embodiments of this invention.

A stopper, generally indicated at 60, interacts with the support post 54 to provide a selective closure to the outlet of water from the basin 32. In embodiments where the housing 36 is generally cylindrical, the stopper 60 may be formed as a body of revolution having a top knob 62 and a wide annular rim 64. The rim 64 may carry an elastomeric O-ring 66 like that shown in FIG. 6. The top end 38 of the housing 36 may be chamfered to create a seat 70 for the O-ring 66 so as to enhance the sealing effectiveness of the stopper 60. The seat 70 can also be merely any flat surface against which a seal is created. The seat 70 can also be located anywhere in the drain passage 46 between the top 38 and bottom 40 ends of the housing 36. As shown by comparison between FIGS. 3 and 4, the stopper 60 is axially movable between raised (FIG. 4) and lowered (FIG. 3) positions. When the stopper 60 is in the raised position, water is generally free to flow through the drain passage 46 of the housing 36. In the lowered position (FIG. 3), the stopper 60 prevents water from flowing through the drain passage 46.

Figure 4:
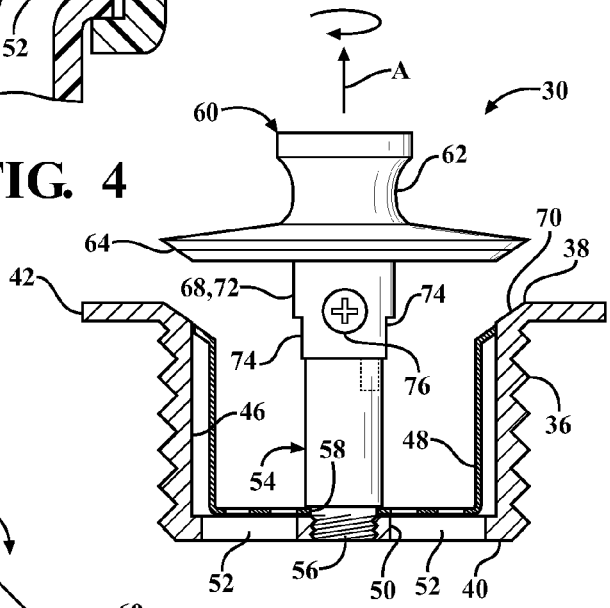
FIG. 4 is a view as in FIG. 3 but showing the stopper disposed in an intermediate raised position wherein water is generally free to flow through the drain passage of the housing.
Figure 5:
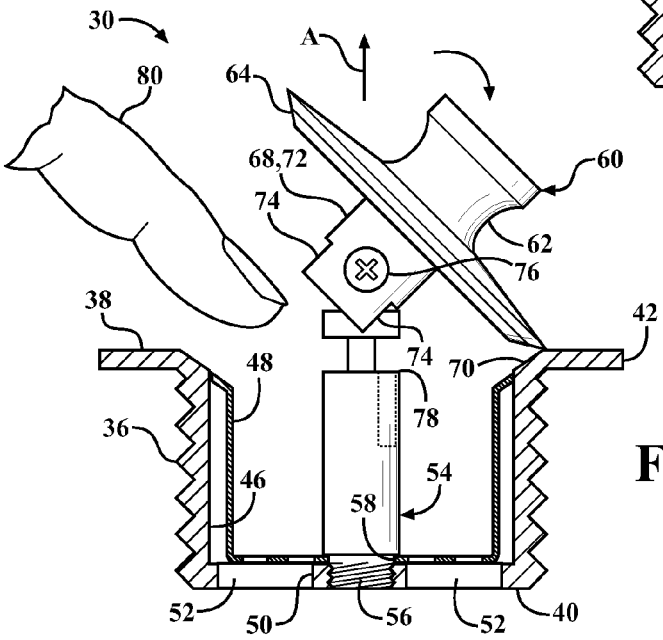
FIG. 5 is a view as in FIG. 4 but showing the stopper lifted to a fully raised position and then moved laterally so as to provide additional clearance for a person's finger or suitable cleaning implement to reach into the drain passage for the purpose of clearing obstructions contained therein.
Figure 6:
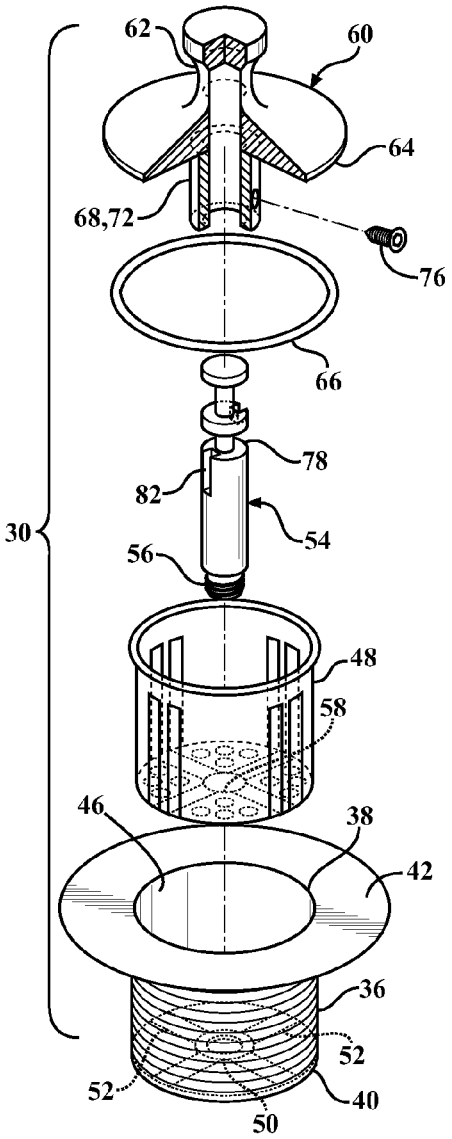
FIG. 6 is an exploded view of the preferred drain stopper assembly as shown in FIG. 5.

Manual force is used to move the stopper 60 between lowered and raised positions, however motion of the stopper 60 is controlled by a post interface 68. The post interface 68 axially slidably engages the support post 54 for allowing the stopper 60 to move axially between raised and lowered positions. The post interface 68 can take any suitable mechanical form, including keyed, grooved or slotted features. In the preferred embodiment, however, the post interface 68 takes the form of a telescopic sliding interface between the stopper 60 and the support post 54. The post interface 68 in the preferred embodiment comprises a sleeve 72 extending downwardly from the rim 64 and slidably engaging the support post 54. In this way, the post interface 68 axially slidably engages the support post 54 for controlling movement of the stopper 60 in a reciprocating—up and down—motion between the respective raised and lowered positions. The sleeve 72 may be a fully developed cylindrical projection or, as shown in FIGS. 3-5 include opposing notches 74. A follower pin 76 is carried by the sleeve 72 for the purpose of interacting with at least one groove 78 formed in the support post 74. The follower pin 76 constrains movement of the stopper 60 to certain predetermined motions established by the groove 78 for purposes which will be described in greater detail subsequently.

As perhaps best shown in FIG. 5, the subject invention includes a lateral displacement means for allowing the stopper 60 to move laterally relative to the longitudinal axis A when it is in the raised position. Such lateral movement of the stopper 60 facilitates periodic cleaning of debris trapped in the drain passage 46. Thus, as shown in FIG. 5, the stopper 60 may be tilted to one side or the other without disassembly thus creating a lateral displacement of its rim 64 so that a human finger 80 or suitable cleaning tool can gain easy access to the drain passage 46 and in particular toward the bottom of the strainer 48 and hub 50/spoke 52 area where hair and other debris is most likely to accumulate. Notches 74 provide clearance to facilitate this lateral movement and thereby form a part of the lateral displacement means together with the groove 78 and follower pin 76 features described earlier.

Figure 7:
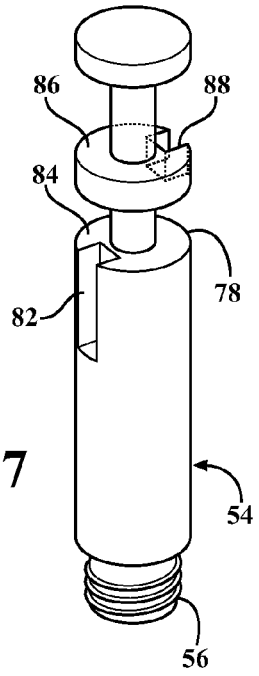
FIG. 7 is a perspective view of the support post according to the preferred embodiment of this invention.

FIG. 7 is an enlarged perspective view of the support post 54 and shows in detail one particular groove 78 pattern which may be employed to achieve the unique functionality of the subject drain stopper assembly 30. In this example, the groove 78 is shown including a first track 82. The first track 82 has a generally straight axial orientation and constrains the stopper 60 to straight axial up and down movement by way of the follower pin 76 therein. When the stopper 60 is in its lowered position as shown in FIG. 3, the follower pin 76 will be located somewhere along the first track 82 Preferably, the follower pin 76 does not bottom out in the first track 82 allowing water pressure in the basin 32 to help maintain a tight sealing pressure between the rim 64 and the chamfered seat 70.

The groove 78 includes a second track 84 which is disposed axially above the first track 82. The second track 84 in this embodiment is disposed in a plane generally perpendicular to the longitudinal axis A. In this embodiment, the second track 84 is formed as a full annular groove around which the follower pin 76 is free to travel and thus spin the stopper 60 in a full revolution. When the follower pin 76 is disposed in this second track 84, the stopper 60 is held in an intermediate raised position which corresponds to the view shown in FIG. 4. In this intermediate raised position, the rim 64 is sufficiently lifted above the seat 70 of the housing so that water can freely flow into the drain passage 64 and escape from the basin 32. The full annular orientation of the second track 84 allows the stopper 64 to be rotated to any position (except a position aligned over the first track 82) and remain there so that no further human interaction is required to maintain the stopper 60 in this intermediate raised position. However, in this intermediate raised position, the stopper 60 is incapable of taking advantage of the lateral displacement means and moving laterally relative to the longitudinal axis A because a length of the support post 54 remains trapped inside the sleeve 72.

The groove 78 further includes a third track 86 disposed axially above the second track 84. The follower pin 76 moves between the second 84 and third 86 tracks via a gap 88 which is preferably, although not necessarily, disposed diametrically opposite the first track 82. When the follower pin 76 is located in the third track 86, the stopper 60 is moved to a full raised position which is above the intermediate raised position. FIG. 5 shows the stopper 60 in its full raised position. In this condition, the sleeve 72 is disposed high enough toward the end of the support post 54 to allow lateral movement away from the longitudinal axis A as shown in FIG. 5. As mentioned earlier, the notches 74 in the sleeve 72 provide additional clearance so that the stopper 60 can be tipped as far as possible for access to the drain passage 46. In this embodiment, the follower pin 76 cannot be removed from the third track 86. However, the follower pin 76 may be formed as a set screw and unthreaded from the sleeve 72 to permit complete removal of the stopper 60 from the support post 54. Accordingly, it will be seen that the lateral displacement means, which includes the interaction between the follower pin 76 and groove 78, together with the configuration of the sleeve 72, remains at least partially immobilized until the follower pin 76 enters the third track 86.

Figure 8:
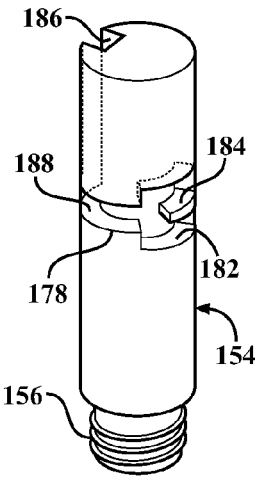
FIG. 8 is a perspective view of the support post member according to a first alternative embodiment of this invention.
Figure 9:
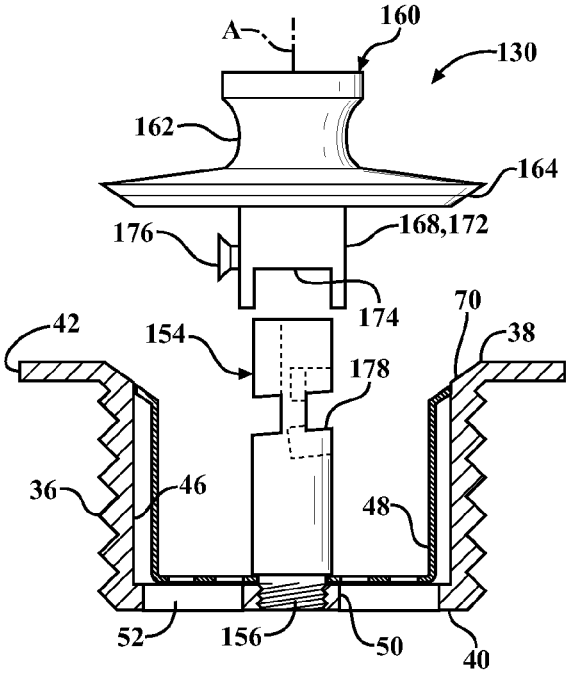
FIG. 9 is a side elevation view of the first alternative embodiment of the drain stopper assembly including the support post of FIG. 8 and showing the stopper separated completely therefrom.

FIGS. 8 and 9 depict a first alternative embodiment of the support post 154. For convenience, all features of the drain stopper assembly as described above are identified with corresponding reference numbers in FIGS. 8-9. However, the support post 154, which is the only feature changed in this first alternative embodiment, is identified with similar reference numbers offset by 100. Also, in FIG. 9 the assembly is generally shown at 130. In this embodiment, the first track 182 is formed as an angular camming surface having a fragmentary, somewhat helical shape and disposed only partway circumferentially about the body of the support post 154. When the follower pin 76 is disposed in the first track 182, rotation of the stopper 60 will cause the follower pin 76 to be pulled or cammed downwardly like screw threads thus pulling the rim 64 and O-ring 66 into tight fitting engagement with the seat 70 of the housing 36. This therefore perfects a tight mechanical seal to prevent water from escaping the basin 32 when the stopper 60 is in its lowered position. Movement of the stopper 60 to the intermediate raised position is accomplished by rotating clockwise until the follower pin 76 can escape from the first track 182 and be moved axially upwardly into the second track 184. The second track 184 in this embodiment is shown as a semi-circular formation which is capable of holding the stopper 60 in a position equivalent to that shown in FIG. 4. Movement of the follower pin 76 from the second track 184 to the third track 186 is accomplished by a counterclockwise rotation of the stopper 60, followed by a short axially downward motion until the follower pin 76 aligns with the gap 188. Clockwise rotation of the stopper 60 then causes the follower pin 76 to travel along the gap 188 until it reaches the third track 186 where it can be lifted axially upwardly until the lateral displacement means is no longer immobilized and lateral movement of the stopper 60 away from the longitudinal axis A can be accomplished like that shown in FIG. 5 and described above. The third track 186, which has a generally straight axial orientation in this embodiment, has an open upper end which allows the follower pin 76 to freely wholly disengage from the support post 154, as shown in FIG. 9.

Figure 10:
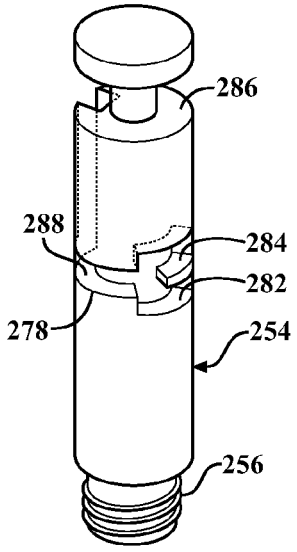
FIG. 10 is a perspective view of a second alternative embodiment of the invention showing a support post member similar in many respects to that of FIG. 8 but including a modified third track capable of preventing complete separation between the stopper and the support post.
Figure 11:
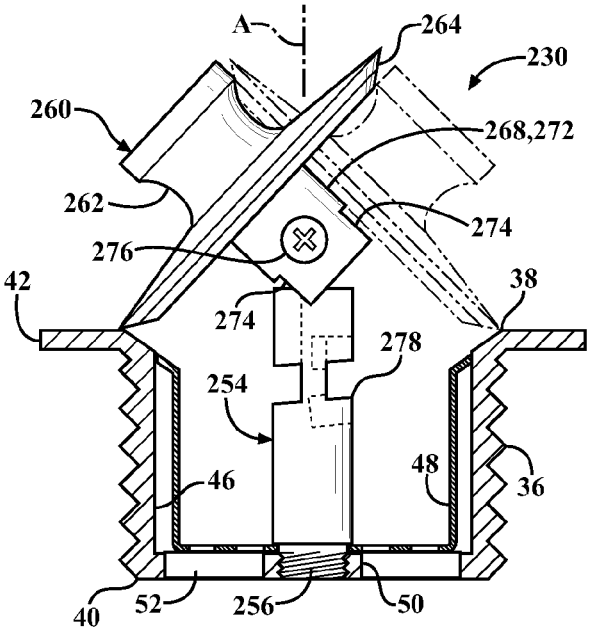
FIG. 11 is a side elevation view of the assembled drain stopper assembly according to the second alternative embodiment and showing the stopper laterally displaced to the left in solid and to the right in phantom.

FIGS. 10 and 11 illustrate a second alternative embodiment which is substantially similar to the first alternative embodiment shown in FIGS. 8-9. In this second alternative embodiment, only the support post 254 is changed. As above, like or corresponding parts to those described in connection with the preferred embodiment are repeated except for the support post 254 which is identified with corresponding reference numbers offset by 200. The assembly is generally shown at 230 in FIG. 10. In this example, the third track 286 includes an annular configuration adjacent its upper end similar in many respects to that shown in FIG. 7. In this embodiment, the follower pin 76 is trapped in the third track 286 and cannot escape but for extraction of the follower pin 76 from the sleeve 72. Thus, the second alternative embodiment 230 differs from the first alternative embodiment 130 (FIG. 8-9) in that the stopper 60 cannot freely and wholly disengage from the support post 254.

Figure 12:
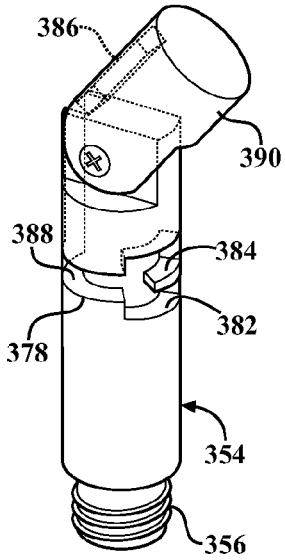
FIG. 12 is a perspective view of a third alternative embodiment of the support post.
Figure 13:
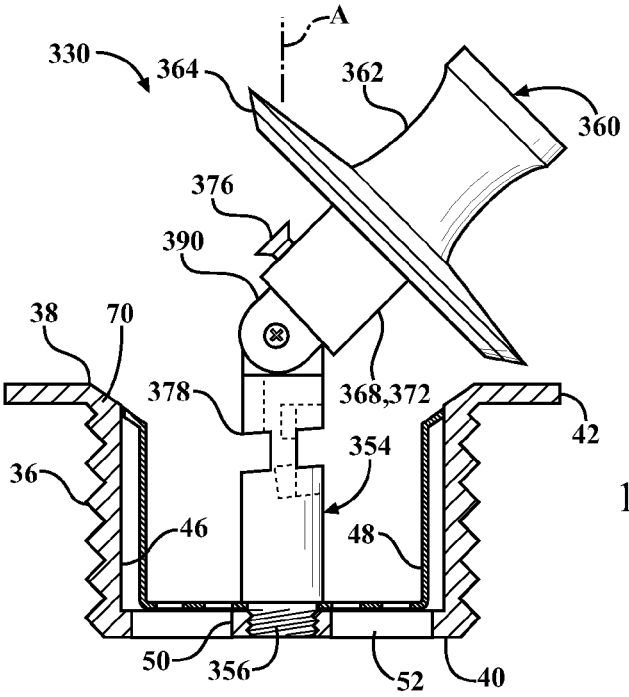
FIG. 13 is a side elevation view of the subject drain stopper assembly according to the third alternative embodiment wherein the stopper is shown laterally displaced for convenient access to the drain passage for cleaning purposes.

Referring now to FIGS. 12 and 13, a third alternative embodiment of the subject drain stopper assembly 330 is shown. Again, as in previous examples, like or corresponding parts which are unaltered relative to the preferred embodiment are indicated with corresponding reference numerals. Revised features are designated with corresponding reference numbers offset by 300. An alternative support post 354 is shown best in FIG. 12 including a pivoting upper section 390 which forms a part of the lateral displacement means and enables lateral displacement of the stopper 60 relative to the longitudinal axis A. The pivoting upper section 390 contains a portion of the third track 386 so that movement of the stopper 60 to its full raised position allows the follower pin 76 to move into the portion of the third track 386 which extends into the pivoting upper section 390. At this stage, lateral movement of the stopper 60 is accomplished by pivoting the stopper 60 together with the upper section 390 as shown in FIG. 13. It will be appreciated that the notches 76 in the sleeve 72 portion of the post interface 68 are not required in this embodiment.

Figure 14:
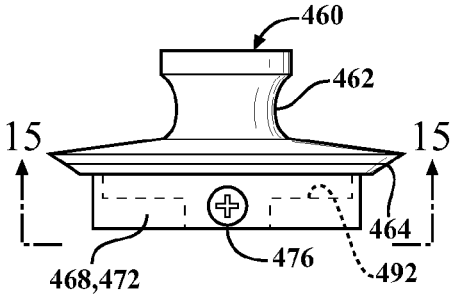
FIG. 14 is a side elevation view of the stopper according to a fourth alternative embodiment as seen along lines 14-14 in FIG. 15.
Figure 16:
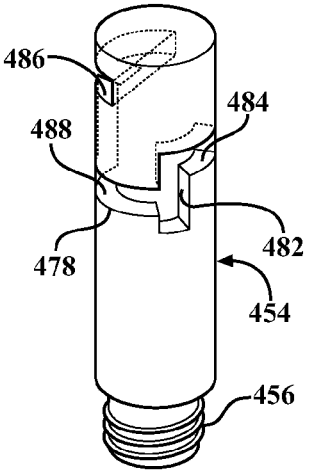
FIG. 16 is a perspective view of the support post according to the fourth alternative embodiment.
Figure 15:
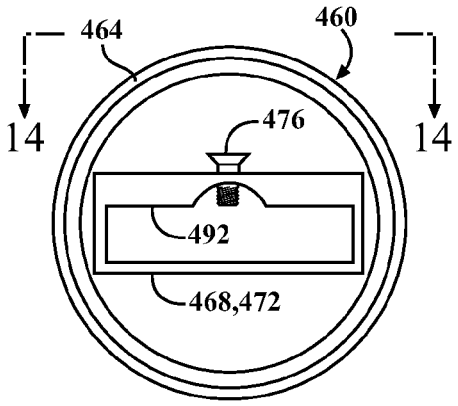
FIG. 15 is a bottom view of the stopper taken generally along lines 15-15 in FIG. 14.
Figure 17:
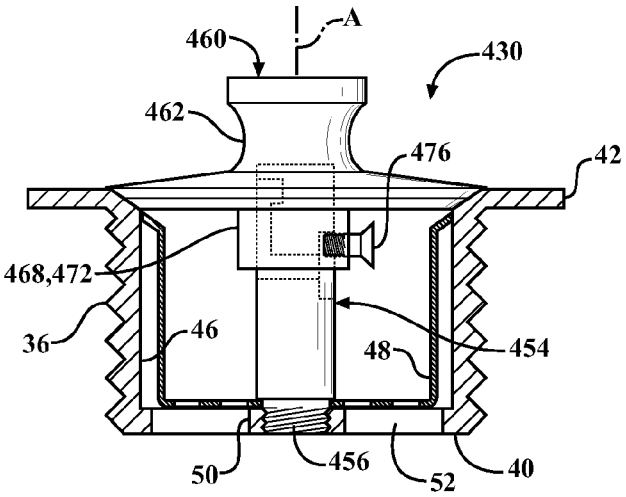
FIG. 17 is a side elevation view of the drain stopper assembly according to the fourth alternative embodiment with the stopper shown in its lowered position closing the drain passage to the housing.
Figure 18:
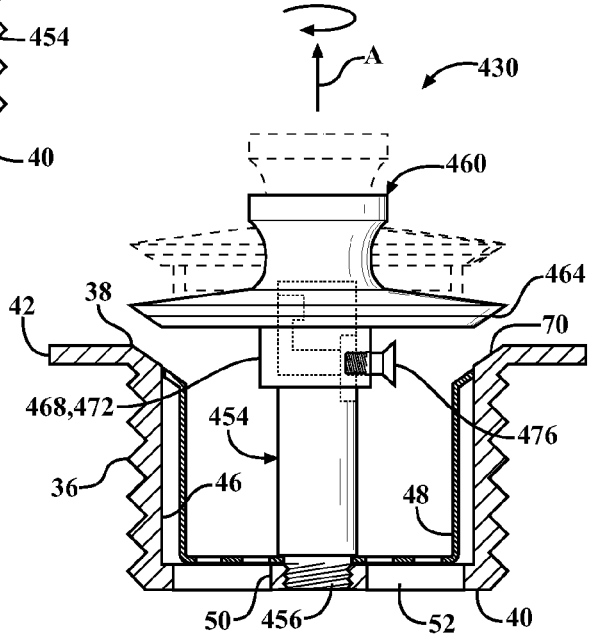
FIG. 18 is a view as in FIG. 17 but showing the stopper in an intermediate raised position in solid lines and a full raised position in broken lines.
Figure 19:
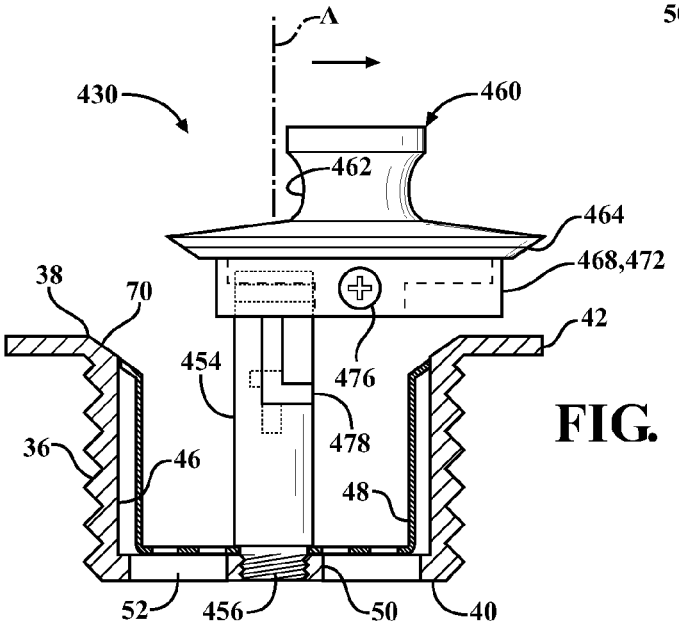
FIG. 19 is a view as in FIG. 18 showing the stopper moved to a laterally displaced position via the lateral displacement means to facilitate clean-out access to the drain passage.

FIGS. 14-19 depict a fourth alternative embodiment of this invention, generally shown at 430. In this embodiment, the housing 36 remains relatively unchanged, however the support post 454 and the stopper 460 are modified. Modified parts are designated with corresponding reference numbers offset by 400. The stopper 460 is shown in FIGS. 14 and 15 with a modified sleeve 472 which is adapted to affect linear sliding movement in a lateral direction relative to the support post 454. In particular, the sleeve 472 includes a spline 492 which, in combination with the follower pin 476, interacts with the third track 486. The support post 454 is shown best in FIG. 16 with the first track 482 comprising a generally straight axial path and the second track 484 comprising a semicircular, generally horizontal path for the follower pin 476 to control movement of the stopper 460 between the lowered position (FIG. 17) and the intermediate raised position (FIG. 18). The gap 488 in this instance comprises a horizontal and vertical passage leading from the first track 482 to the third track 486. The third track 486 in this case comprises a generally horizontal slideway for the spline 492. Thus, when the stopper 460 is in its full raised position as shown in FIG. 19 (and shown in phantom in FIG. 18), the stopper 460 can be manually pushed in either direction laterally along the longitudinal axis A, thus accomplishing the function of the lateral displacement means.

Figure 20:
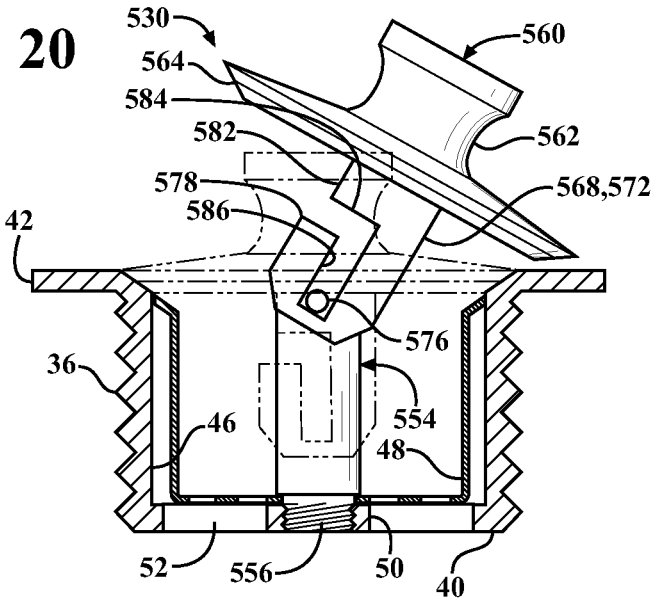
FIG. 20 is a side elevation view of the subject drain stopper assembly according to a fifth alternative embodiment showing the stopper in a raised and laterally displaced condition in solid lines and a lowered position in phantom lines.

A fifth alternative embodiment of the subject invention is generally shown at 530 in FIG. 20. In this example, like or corresponding parts for the modified support post 554 and stopper 560 have been offset by 500. This fifth alternative embodiment illustrates the manner in which the location of groove 578 and follower pin 576 features can be reversed between the support post 554 and stopper 560 elements. In particular, the follower pin 576 is attached to and extends laterally outwardly from the support post 554 in this embodiment. The groove 78 is formed in the sleeve 572 depending from the stopper 560. A first track 582 allows the stopper 560 to achieve a lowered position (shown in phantom). The stopper 560 can be maintained in an intermediate raised position (not shown) via a second track 584. When the follower pin 576 is disposed in the third track 586, the stopper 560 can be moved to a fully raised position and then laterally displaced as shown in solid lines in FIG. 20.

Figure 21:
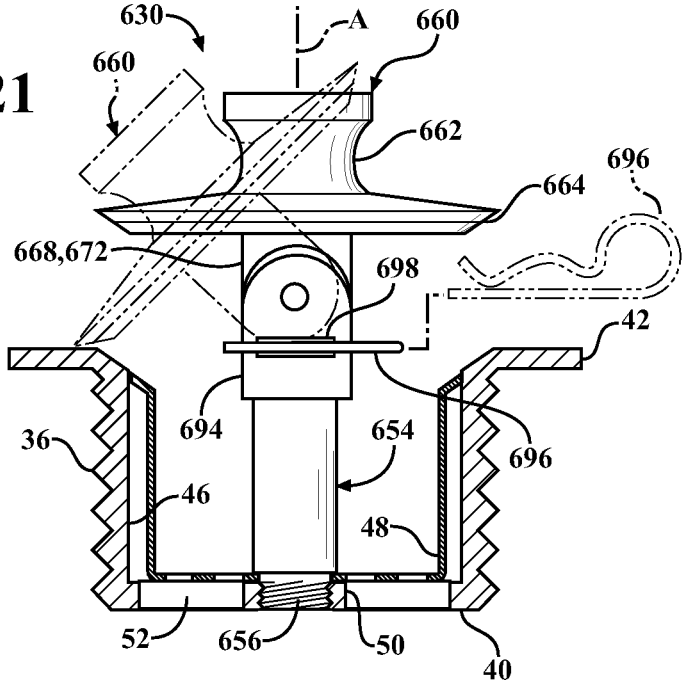
FIG. 21 is a side elevation of the subject drain stopper assembly according to a sixth alternative embodiment.

A sixth alternative embodiment of the subject invention is generally shown at 630 in FIG. 21, where the support post 654 and stopper 660 features are identified with similar reference numerals but offset by 600. In this example, the novel lateral displacement means is accomplished without the use of a groove and follower pin arrangement. Instead, in this example the lateral displacement means is formed in combination with the post interface 668 by adding a pivoted lower section 694 to the sleeve 672. In this case, when the stopper 660 is raised to a sufficiently elevated position (i.e., the sleeve 676 clears the top of the support post 654), the stopper 660 can be rotated or pivoted to the position shown in phantom. The pivoted lower section 694 slides along the support post 654 under the influence of a frictional relationship created by a spring clip 696. The spring clip 696 is placed in a slot 698 formed completely through the lower pivoted section so that one leg of the spring clip 696 can bear directly upon the outer surface of the support post 654. Although not apparent from the illustration in FIG. 21, the support post 654 may or may not be formed at its upper most end with a lip or other feature to restrict separation of the stopper 660, together with the pivoted lower section 694, completely from the support post 654.

The friction feature can be accomplished in a variety of ways alternative to the spring clip 696. For example, friction can be accomplished by use of a circlip or O-ring interface between the male and female sliding members, by a flexible collet-type relationship, by the use of other types of spring clips as well as many other techniques. All such techniques known in the art are contemplated.

Referring now to FIGS. 22-23, a seventh alternative embodiment of the subject invention is generally shown at 730, with modified support post 754 and stopper 760 features identified by reference numerals offset by 700. In this example, the support post 754 is fabricated from a flexible material composition, and in particular a tightly wound spring-like construction. As a result, when the stopper 760 is moved to a raised position, the flexible support post 754 yields under a laterally applied force so that a human finger 80 can easily access the drain passage 46 and remove any obstructions. This embodiment utilizes a spring clip 796 disposed in a slot 798 formed in the sleeve 772 similar to that described above in connection with the sixth alternative embodiment of FIG. 21. Like that previous embodiment, the uppermost terminal end of the support post 754 may or may not be formed with a flange or other feature to prevent free and full disengagement of the stopper 760 from the support post 754.

FIGS. 24 and 25 depict still further alternative designs and constructions for the support post without departing from the spirit of this invention. These further alternative support post designs are intended to enlighten those of skill in the art to the great variety of alternative constructs which may be used to achieve the novel movement of the stopper feature via the lateral displacement means described above. Furthermore, the various unique configurations described among the preferred and alternative embodiments can likewise be intermingled in various ways to create still further permutations of the invention. Accordingly, it is not intended that the scope of this invention be limited to the specific embodiments illustrated and described.

The present invention therefore comprises a drain stopper assembly providing easy and greater access to the drain passge 46 than possible using prior art techniques. In particular, this improved access to the drain passage 46 can be enjoyed without removing the entire stopper, although some embodiments do permit removal of the stopper. Furthermore, the proportions of the components, and in particular the relative lengths of the post interface and support post, can be modified substantially to achieve different degrees of stopper displacement both axially and laterally.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A drain stopper assembly for selectively closing the outlet from a water basin such as a sink or bathing tub, said stopper assembly comprising:

a housing adapted to insert into a drain hole opening in a basin for establishing a drain passage through which water flows when draining from the basin; said housing defining a longitudinal axis;

a support post supported relative to said housing within said drain passage;

a stopper; said stopper including a post interface axially slideably engaging said support post for allowing said stopper to move axially between respective raised and lowered positions, whereby when said stopper is in said raised position water is generally free to flow through said drain passage of said housing and in said lowered position said stopper prevents water from flowing through said drain passage; and lateral displacement means for allowing said stopper to move laterally relative to said longitudinal axis when in said raised position to facilitate periodic cleaning of debris trapped in said drain passage;

wherein said lateral displacement means includes at least one groove in said support post and a follower pin carried by said post interface;

wherein said at least one groove comprises a first track in which said follower pin is located when stopper is in said lowered position;

wherein said at least one groove includes a second track disposed axially above said first track and in which said follower pin is located when stopper is in an intermediate raised position; and wherein said at least one groove comprises a third track disposed axially above said second track and in which said follower pin is located when stopper is in a full raised position above said intermediate raised position; said lateral displacement means being at least partially immobilized until said follower pin enters said third track.

2. The stopper assembly of claim 1, wherein said first track has an angular camming surface.

3. The stopper assembly of claim 1, wherein said first track has a generally straight axial orientation.

4. The stopper assembly of claim 1, wherein said second track is disposed in a plane generally perpendicular relative to said longitudinal axis.

5. The stopper assembly of claim 1, wherein said second track has a generally annular configuration.

6. The stopper assembly of claim 1, wherein said third track has a generally straight axial orientation.

7. The stopper assembly of claim 6, wherein said third track has an open top end whereby said follower pin is free to wholly disengage from said support post upon passing said open top end.

8. The stopper assembly of claim 6, wherein said third track is disposed in a plane generally perpendicular relative to axis.

9. The stopper assembly of claim 8, wherein said third track has a generally annular configuration.

10. The stopper assembly of claim 1, wherein said lateral displacement means includes a pivoting section in at least one of said support post and said post interface.

11. The stopper assembly of claim 1, wherein said post interface comprises a sleeve surrounding said support post in sliding engagement, and a follower pin carried by said sleeve.

12. The stopper assembly of claim 1, further including a removable strainer disposed in said housing.

13. The stopper assembly of claim 1, wherein said housing includes axially spaced apart top and bottom ends; a hub disposed within said drain passage adjacent said bottom end of said housing; said support post affixed to said hub and extending generally upwardly therefrom.

14. The stopper assembly of claim 13, wherein said housing is generally cylindrical and centered about said longitudinal axis; said hub and said support post disposed generally along said longitudinal axis; at least one spoke extending between said hub and said housing.

15. The stopper assembly of claim 13, further including a mounting flange extending radially outwardly from said top end of said housing.

16. A cleanable drain stopper assembly for a basin such as a sink or bathing tub, said stopper assembly comprising:

a cylindrical housing adapted to insert into an opening in a basin; said housing defining a central longitudinal axis and including axially spaced apart top and bottom ends; a stopper seat disposed in said top end of said housing; a mounting flange extending radially outwardly from said top end of said housing; a hub disposed within said housing adjacent said bottom end;

a support post extending upwardly from said hub;

a stopper; said stopper including a telescopic post interface axially slideably engaging said support post for allowing said stopper to move axially between respective raised and lowered positions, whereby said stopper is spaced apart from said seat in said raised position and in direct engagement with said stopper seat in said lowered position; said telescopic post interface comprising a sleeve surrounding said support post in sliding engagement; said stopper including an annular elastomeric seal configured to engage said stopper seat of said housing and create a generally fluid tight interface therebetween when said stopper is in said lowered position; said stopper having a grip knob;

a strainer disposed in said housing; said strainer having a generally cylindrical shape with a bottom adapted to abut said hub; said bottom including a central hole for receiving said support post; and lateral displacement means for allowing said stopper to move laterally relative to said longitudinal axis when in said raised position to facilitate periodic cleaning of debris trapped in said housing adjacent said hub; said lateral displacement means including at least one groove in said support post and a follower pin carried by said telescopic post interface; said at least one groove including a first track in which said follower pin is located when stopper is in said lowered position; said at least one groove including a second track disposed axially above said lower-most track and in which said follower pin is located when stopper is in an intermediate raised position; said at least one groove including a third track disposed axially above said second track and in which said follower pin is located when stopper is in a full raised position above said intermediate raised position; said lateral displacement means being effectively immobilized when said stopper is in said lowered position.

* * * * *